US009969550B2

(12) United States Patent
McConnell et al.

(10) Patent No.: US 9,969,550 B2
(45) Date of Patent: May 15, 2018

(54) DISPOSABLE BAG AND THE METHOD OF USING THE SAME

(71) Applicant: 1316 LLC, Los Vegas, NV (US)

(72) Inventors: Thomas E. McConnell, Santa Ynez, CA (US); Yafei Lu, Jiangsu (CN)

(73) Assignee: 1316 LLC, Las Vegas, NV (US)

( * ) Notice: Subject to any disclaimer, the term of this patent is extended or adjusted under 35 U.S.C. 154(b) by 0 days. days.

(21) Appl. No.: 14/838,247

(22) Filed: Aug. 27, 2015

(65) Prior Publication Data

US 2016/0060029 A1 Mar. 3, 2016

Related U.S. Application Data

(63) Continuation-in-part of application No. 14/473,766, filed on Aug. 29, 2014, now Pat. No. 9,438,508, which is a continuation-in-part of application No. 14/473,685, filed on Aug. 29, 2014, now Pat. No. 9,434,537.

(51) Int. Cl.

| | |
|---|---|
| ***B65D 33/16*** | (2006.01) |
| ***B65F 1/00*** | (2006.01) |
| ***B65F 1/06*** | (2006.01) |
| *B65F 1/14* | (2006.01) |

(52) U.S. Cl.

CPC ..... *B65F 1/002* (2013.01); *B65F 1/0006* (2013.01); *B65F 1/06* (2013.01); *B65F 1/0013* (2013.01); *B65F 1/1426* (2013.01); *B65F 2210/1675* (2013.01); *B65F 2240/132* (2013.01)

(58) Field of Classification Search

CPC ..... B65F 1/06; B65F 1/0006; B65F 1/1426; B65F 1/002; B65F 1/0013; B65F 2210/1675; B65F 2240/132; B65B 7/12

USPC ..... 220/495.08, 908, 908.1; 383/61.1, 62, 383/104, 33, 34, 34.1, 35, 71, 906; 53/483, 370

See application file for complete search history.

(56) References Cited

U.S. PATENT DOCUMENTS

| | | | | |
|---|---|---|---|---|
| 1,633 A * | 6/1840 | Sellers et al. | ..... | A01M 31/00 383/34.1 |
| 5,061,086 A * | 10/1991 | Vallerga | ..... | A45C 1/00 150/102 |
| 2007/0031068 A1* | 2/2007 | Gillis | ..... | A61J 19/00 383/33 |
| 2008/0310772 A1* | 12/2008 | Dayton | ..... | A41D 19/0075 383/61.1 |

* cited by examiner

*Primary Examiner* — J. Gregory Pickett
*Assistant Examiner* — Elizabeth Volz
(74) *Attorney, Agent, or Firm* — WPAT, P.C., Intellectual Property Attorneys; Anthony King

(57) ABSTRACT

A bag for holding trash, diaper, and any item that needs to be contained. The bag can have an enclosure body and a mouth opening where the opening is lined with a foldable frame. The foldable frame can fold out to keep the mouth opening in an open configuration, and can collapse upon itself to keep the mouth opening in a closed configuration. The foldable frame can optionally have a locking notch, a finger, or both, all of which can be used to attach to some part of the enclosure body thereby keeping the neck of the bag twisted closed. The bag can optionally have attachment points such as apertures, sleeves, strips, and loops for securing to the locking notch. In some embodiments, the collar need not be foldable.

11 Claims, 17 Drawing Sheets

DISPOSABLE BAG AND THE METHOD OF USING THE SAME

CROSS-REFERENCE TO RELATED APPLICATIONS

This application claims priority to, and is a Continuation-In-Part of, U.S. patent application Ser. No. 14/473,776 which is a Continuation-In-Part application of U.S. patent application Ser. No. 14/473,685, both of which were filed on Aug. 29, 2014, and both are now pending, all of which are hereby incorporated by reference in their entireties. Although incorporated by reference in its entirety, no arguments or disclaimers made in the parent applications apply to this Continuation-In-Part application. Any disclaimer that may have occurred during the prosecution of the above-referenced applications is hereby expressly rescinded. Consequently, the Patent Office is asked to review the new set of claims in view of all of the prior art of record and any search that the Office deems appropriate.

FIELD OF THE DISCLOSURE

The field of the disclosure is bag enclosures, more specifically, bags for waste containers such as diaper pails.

BACKGROUND

Various types of garbage bags are known and used in everyday life. Typically a garbage bag is made of plastic sheets. In prior art garbage bags, the mouth of the bag has cinching straps, allowing a user to cinch the bag closed when needed.

Another way to close the bag includes tying a knot; there is a continuing need for new ways to close a garbage bag when the bag is full.

All referenced patents, applications and literatures are incorporated herein by reference in their entireties. Furthermore, where a definition or use of a term in a reference which is incorporated by reference herein is inconsistent or contrary to the definition of that term provided herein, the definition of that term provided herein applies and the definition of that term in the reference does not apply. The disclosure may seek to satisfy one or more of the above-mentioned desires. Although the present disclosure may obviate one or more of the above-mentioned desires, it should be understood that some aspects of the disclosure might not necessarily obviate them.

BRIEF SUMMARY OF THE DISCLOSURE

One aspect of the disclosure is directed to a disposable bag assembly having necessary hardware intended for quick and easy installation into a diaper pail system. In another aspect of the disclosure, the disposable bag assembly is not only for a particular diaper pail but is universally acceptable for use in garbage cans, so long as the collar structure of the disposable bag is appropriately sized and shaped to fit over the upper rim of the garbage can. In some other embodiments, the disclosure is directed to a disposable bag with a foldable collar, wherein the collar can collapse onto itself and has a receiving structure which helps keeping the bag's neck in a twisted closed configuration, thereby effectively sealing the bag.

In one contemplated embodiment, the receiving structure is a locking notch, which can be located on various parts of the collar. The notch can be a cutout that serves as a catch to hook around a twisted neck of the bag or around another part of the bag. In operation, the user would remove the bag from the waste container, fold the collar, and then use the locking notch to keep the bag in a twisted closed configuration.

Various objects, features, aspects and advantages of the present disclosure will become more apparent from the following detailed description of preferred embodiments of the disclosure, along with the accompanying drawings in which like numerals represent like components.

BRIEF DESCRIPTION OF THE DRAWINGS

It should be noted that the drawing figures may be in simplified form and might not be to precise scale. In reference to the disclosure herein, for purposes of convenience and clarity only, directional terms such as top, bottom, left, right, up, down, over, above, below, beneath, rear, front, distal, and proximal are used with respect to the accompanying drawings. Such directional terms should not be construed to limit the scope of the disclosure in any manner.

DETAILED DESCRIPTION OF THE DISCLOSURE

The disclosure and its various embodiments can now be better understood by turning to the following detailed description of the preferred embodiments which are presented as illustrated examples of the disclosure defined in the claims. It is expressly understood that the disclosure as defined by the claims may be broader than the illustrated embodiments described below.

The words used in this specification to describe the disclosure and its various embodiments are to be understood not only in the sense of their commonly defined meanings but to include by special definition in this specification structure, material, or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims therefore include not only the combination of elements which are literally set forth but all equivalent structure, material, or acts for performing substantially the same function in substantially the same way to obtain substantially the same result. In this sense it is therefore contemplated that an equivalent substitution of two or more elements may be made for any one of the elements in the claims below, or that a single element may be substituted for two or more elements in a claim. Although elements may be described above as acting in certain combinations and even are initially claimed as such, it is to be expressly understood that one or more elements from a claimed combination can in some cases be excised from the combination, and that the claimed combination may be directed to a subcombination or variation of a subcombination.

Figure 1:
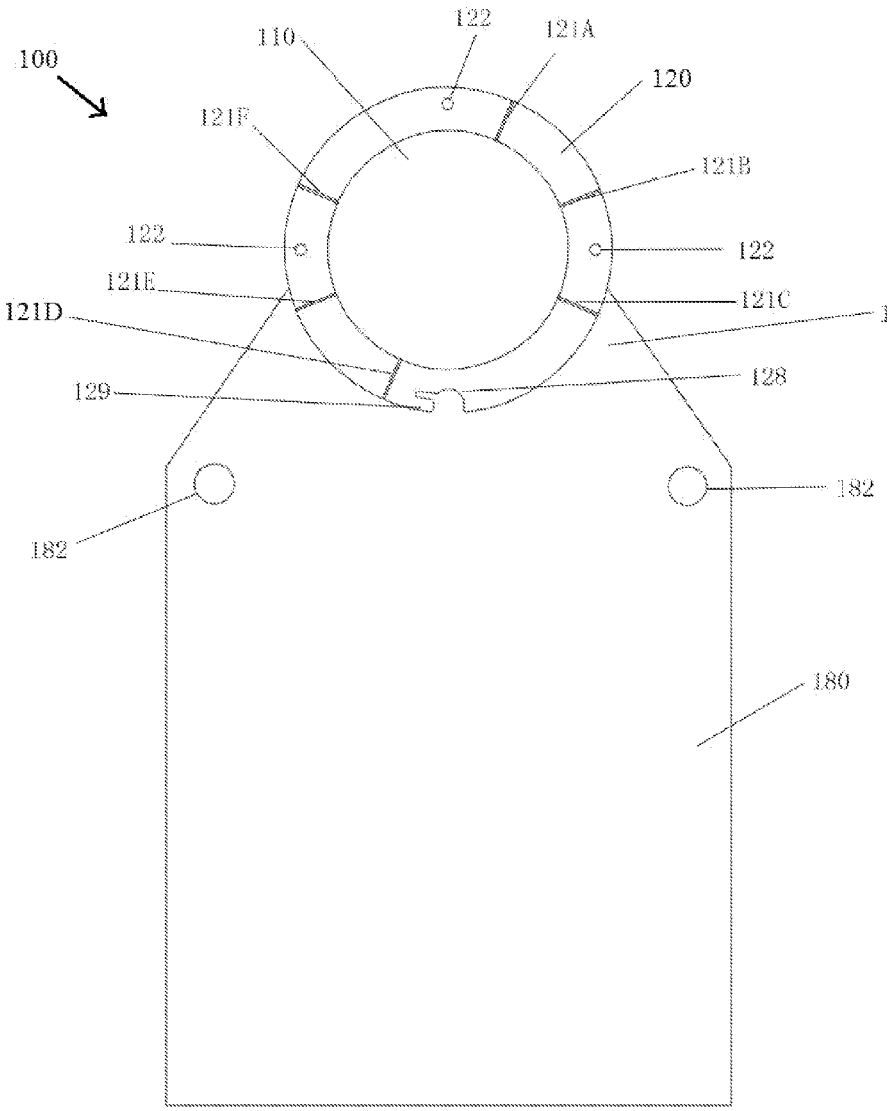
FIG. 1 is a side view of an embodiment of the disposable bag having the foldable collar tilted 90 degrees in order to reveal the circular mouth opening of the bag.

With respect to FIG. 1, a contemplated disposable bag 100 is shown having an enclosure body 180 with an internal space for holding trash, used diapers, and any other garbage. The bag 100 can have a neck portion 189 coupled to the body portion, and the neck portion acts as a conduit between the opening 110 (i.e., a mouth) and the internal space of the body portion 180. Although it is called a "neck," the neck portion 189 does not necessarily have to be narrower than the body portion 180. The neck portion 189 simply signifies a section of the bag 100 that is generally located below the opening 110 and above the body portion 180.

The opening 110 is defined by an upper rim of the disposable bag 100, and the upper rim is above and coupled to the neck portion 189. The upper rim of the disposable 100 is coupled to a foldable collar 120. This foldable collar can couple directly and permanently to the upper rim or couple to the bag 100 near the upper rim. In most embodiments, the bag 100 is coupled to the foldable collar 120 along the entire circumference of the upper rim.

The purpose of the foldable collar 120 is to act as a coupler, so that the disposable bag 100 can detachably attach to a waste container having a corresponding structure which receives the foldable collar 120.

Figure 2:
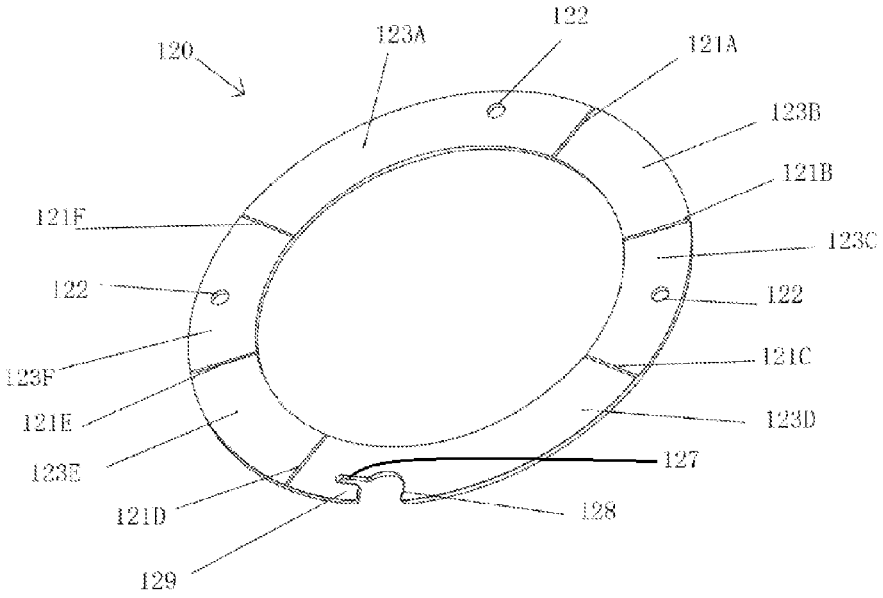
FIG. 2 is a top angled perspective view of one embodiment of the foldable collar without showing the enclosure body.
Figure 3:
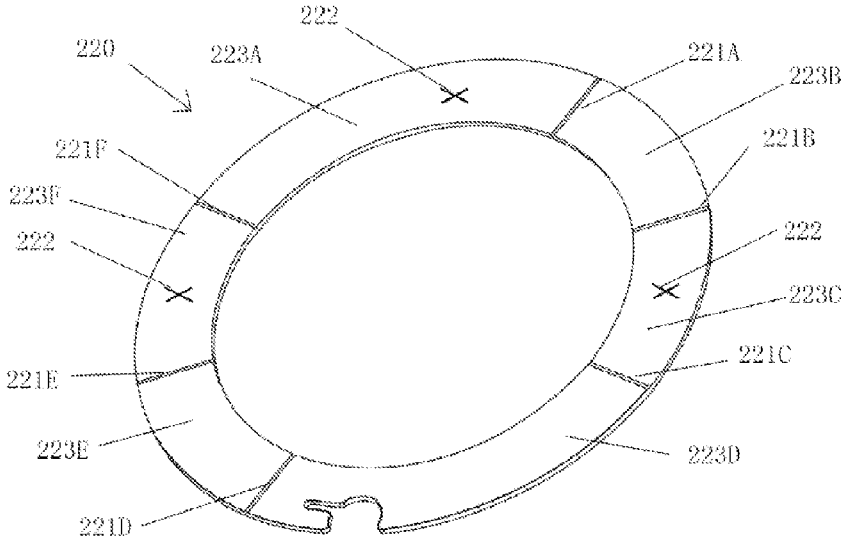
FIG. 3 is a top angled perspective view of another embodiment of the foldable collar without showing the enclosure body.
Figure 4:
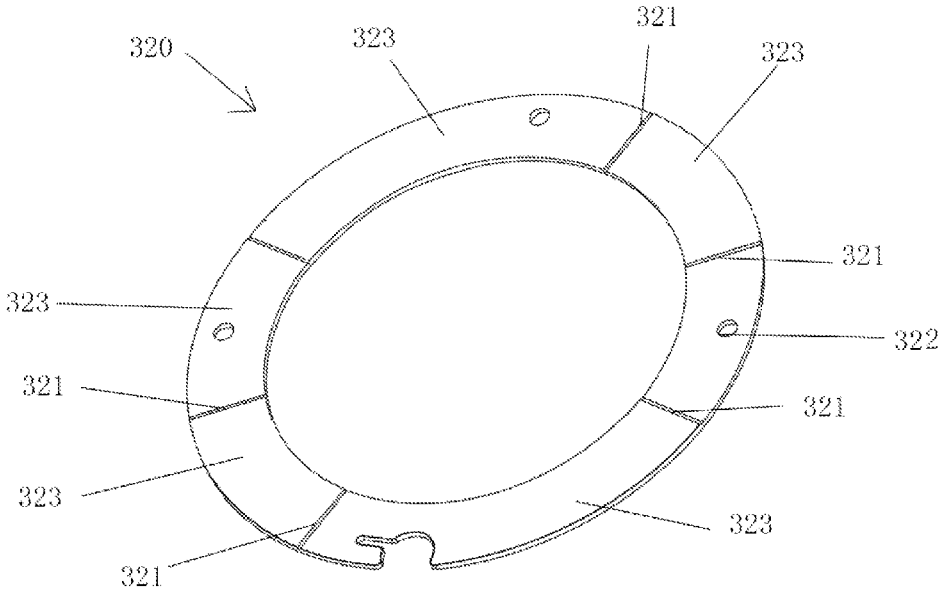
FIG. 4 is a top angled perspective view of yet another embodiment of the foldable collar without showing the enclosure body.
Figure 5:
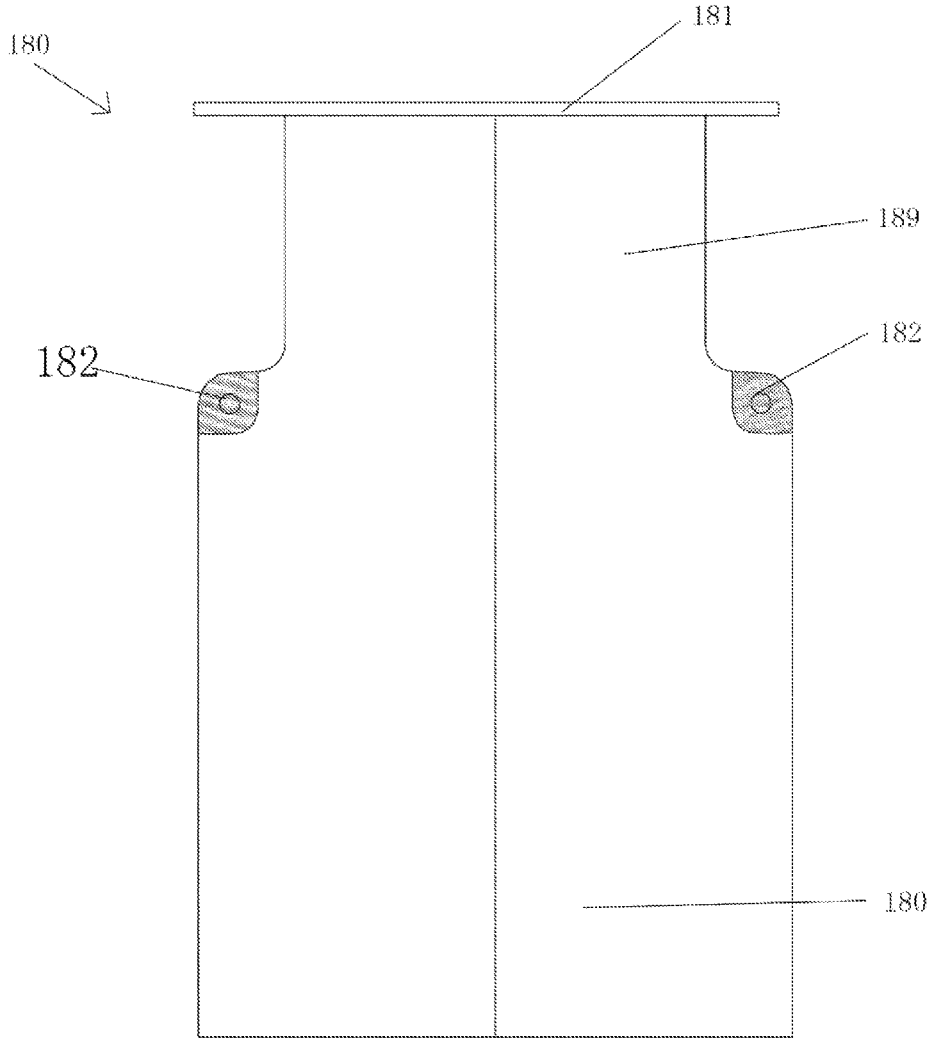
FIG. 5 is a side view of one embodiment illustrating a side view of the foldable collar and reinforced apertures on the enclosure body.

Referring now to FIG. 2, an embodiment of foldable collar 120 is provided to have six collar bodies 123A, 123B, 123C, 123D, 123E, 123F consecutively coupled to one another in a circular fashion. These collar bodies 123A, 123B, 123C, 123D, 123E, 123F are connected via pre-scored folding lines 121A, 121B, 121C, 121D, 121E, 121F such that two adjacent collar bodies may readily pivot in relation to each other. These collar bodies may be made of any natural and/or synthetic material, and can be made of cardboard. One skilled in the art would immediately recognize there are many ways to manufacture such foldable collar, using various types of materials.

Figure 12:
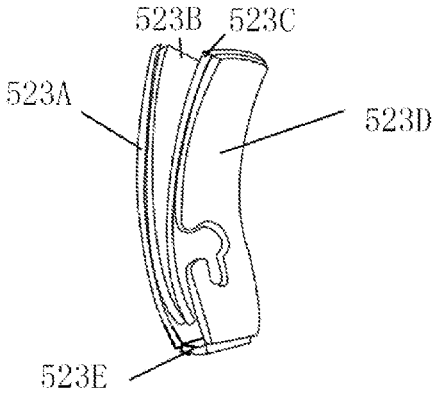
FIG. 12 is an illustration of a foldable collar employing five collar bodies.
Figure 13:
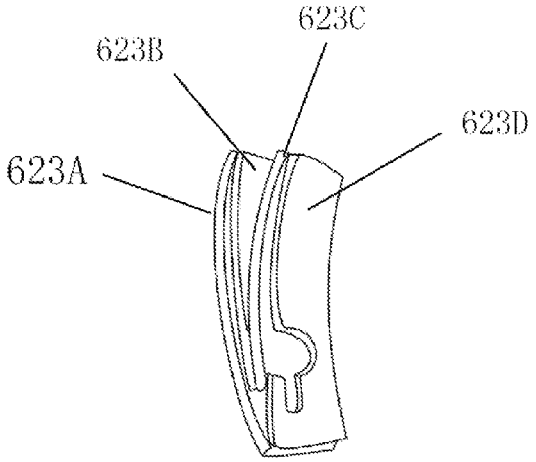
FIG. 13 is an illustration of a foldable collar employing four collar bodies.

Although FIGS. 1, 2, 3, 4, 7, 8A, 8B, 9A, 9B, 9C, 9D, 10, and 11 in the disclosure show an embodiment of foldable collar 120 having six collar bodies 123A, 123B, 123C, 123D, 123E, 123F, it should be especially noted that any number of collar bodies are feasible. In one embodiment, the foldable collar can have at least two collar bodies. In another embodiment, the foldable collar can have five collar bodies (see FIG. 12). In yet another embodiment, the foldable collar can have four collar bodies (see FIG. 13). FIGS. 11, 12, and 13 illustrate how various numbers of collar bodies collapse onto themselves.

In most embodiments, the collar bodies 123A, 123B, 123C, 123D, 123E, 123F are flat panels pivotably connected to another via folding lines 121A, 121B, 121C, 121D, 121E, 121F as discussed above. The collar bodies 123A, 123B, 123C, 123D, 123E, 123F are configured to fold out into a co-planar configuration, thereby keeping the mouth opening 110 of the bag 100 in an open configuration as shown in FIGS. 1, 8A, 8B, 9A, 9B, 9C, and 9D. The collar bodies 123A, 123B, 123C, 123D, 123E, 123F are also configured to fold in, or collapse onto themselves, such that the collar bodies 123A, 123B, 123C, 123D, 123E, 123F are eventually substantially parallel to each other, or stacked, thereby keeping the mouth opening of the bag in a closed configuration (see FIGS. 10, 11, 12, and 13).

Figure 10:
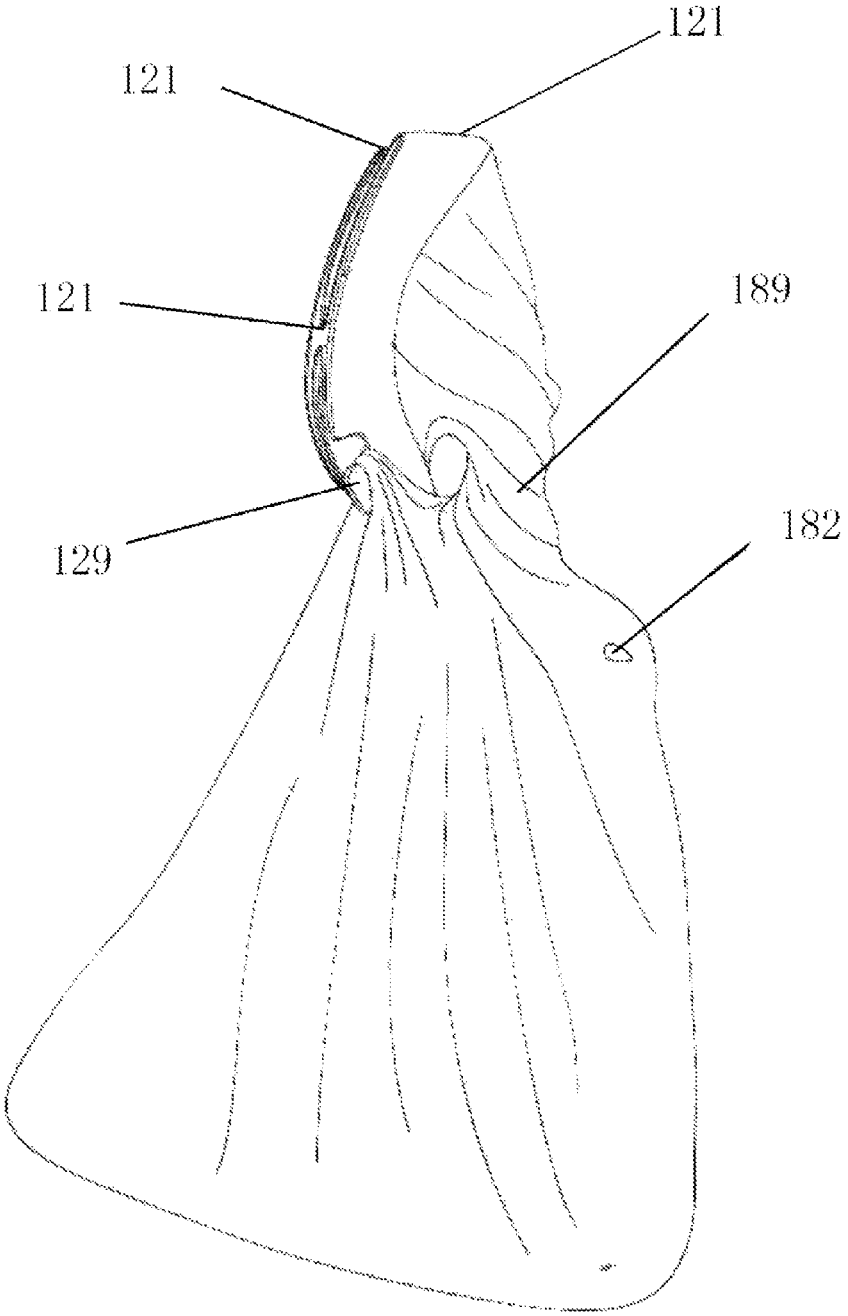
FIG. 10 is a perspective view of the embodiment in FIG. 9A where the foldable collar is collapsed, showing the twisted neck.
Figure 11:
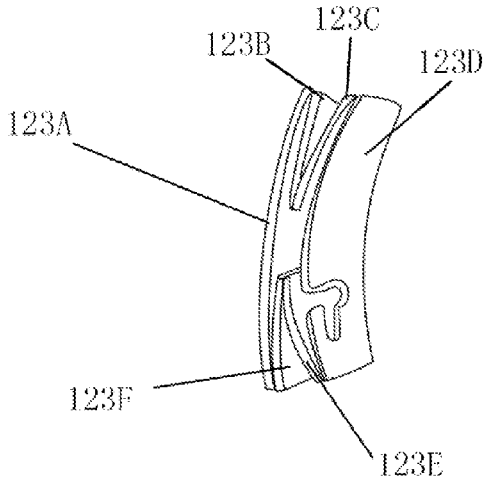
FIG. 11 is an illustration of a foldable collar employing six collar bodies.

In the embodiment shown in FIGS. 10 and 11, when the collar bodies 123A, 123B, 123C, 123D, 123E, 123F are in a collapsed configuration, four of the collar bodies 123B, 123C, 123E and 123F are sandwiched between two of the collar bodies 123A and 123B.

In the embodiment shown in FIG. 12, when the collar bodies 523A, 523B, 523C, 523D, 523E collapse onto themselves, two of the collar bodies 523B and 523C are sandwiched between collar bodies 523A and 523D. A smaller collar body 523E simply acts as a connecting piece between collar bodies 523A and 523D.

In the embodiment shown in FIG. 13, when the collar bodies 623A, 623B, 623C, and 623D collapse onto themselves, two of the collar bodies 623B and 623C are sandwiched between collar bodies 523A and 523D.

Figure 14A:
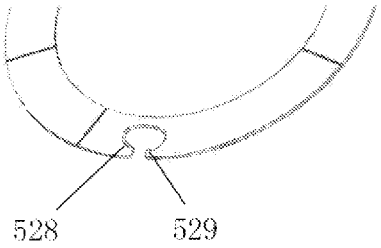
FIG. 14A is an illustration of a locking notch having a cove-shaped structure.
Figure 14B:
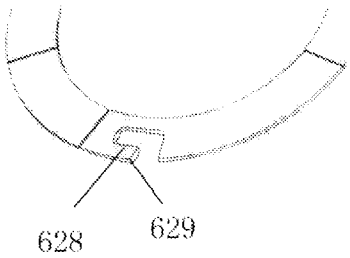
FIG. 14B is an illustration of a locking notch having an L-shaped structure.
Figure 14C:
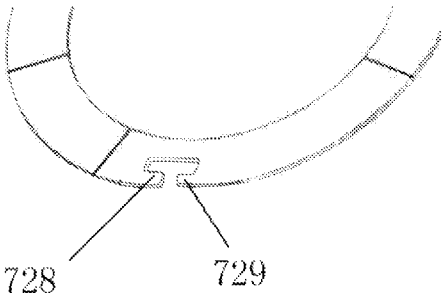
FIG. 14C is an illustration of a locking notch having a T-shaped structure.

In some contemplated embodiments, for example the embodiment shown in FIG. 2, at least one of the collar bodies 123A, 123B, 123C, 123D, 123E, 123F has a finger 129. In FIG. 2, collar body 123D has a finger 129 formed as part of a locking notch 128. It should be noted that the term "finger" 129 does not limit its structure to a specific width, length, shape, or angle. The finger 129 can be any protuberance. In the embodiment of FIG. 2, the finger 129 is formed as an integral part of collar body 123D, and it is substantially flat and co-planar with the collar body 123D. The "finger" can also be part of the entrance area that is narrower than the inside void of a cove-like structure as illustrated in FIG. 14A, FIG. 14A shows a locking notch having a cove-like structure 528, where the entrance (formed by opposing fingers 529) is narrower than the inside void. FIG. 14B shows an L-shaped locking notch 628 having a finger 629. FIG. 14C shows a T-shaped locking notch 728 having a finger 729.

Figure 8A:
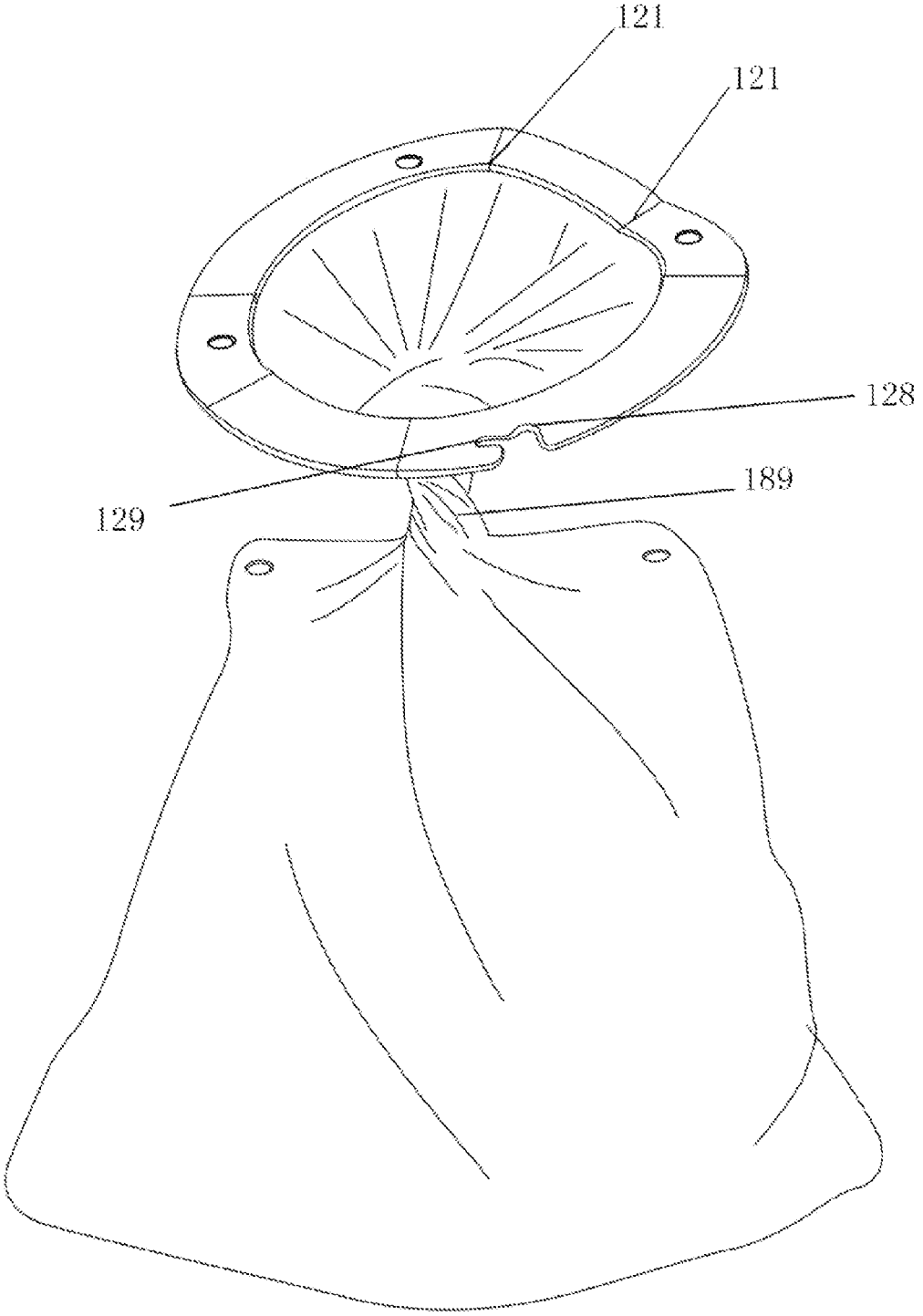
FIG. 8A is a perspective view of one embodiment of the disposable bag with a twisted neck.
Figure 8B:
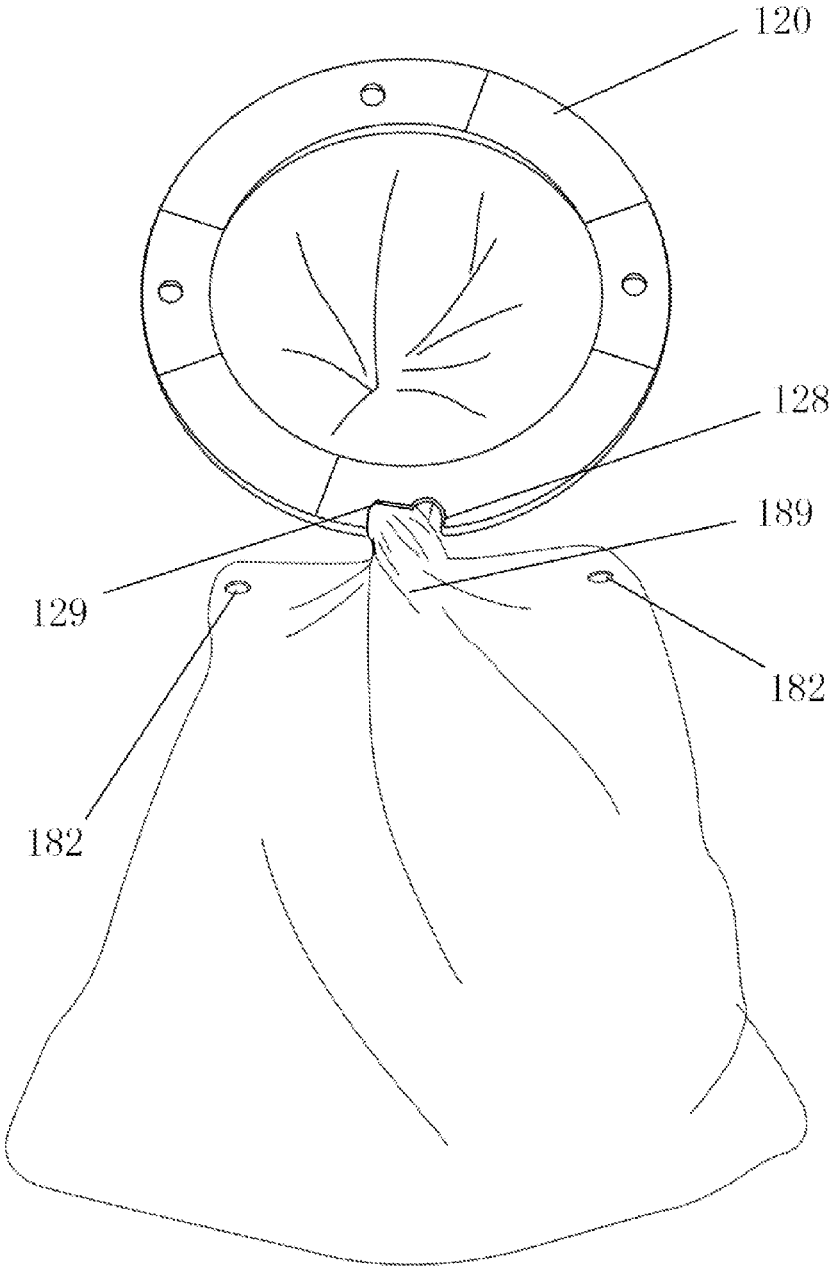
FIG. 8B is a perspective view of the embodiment of 8A, where the twisted neck is received within the locking notch.
Figure 9A:
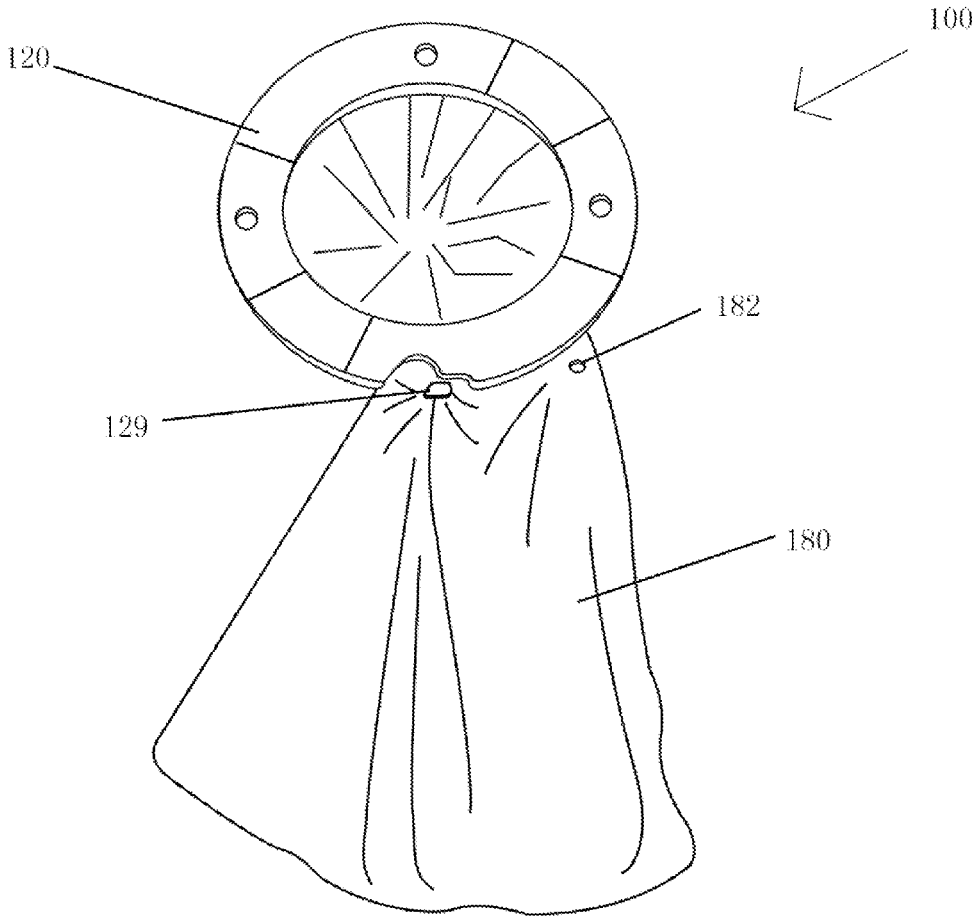
FIG. 9A is a perspective view of one embodiment of the disposable bag also with a twisted neck but the twisted neck is hidden behind the foldable collar. This figure illustrates a finger of the foldable collar being engaged with an aperture of the enclosure body.
Figure 9B:
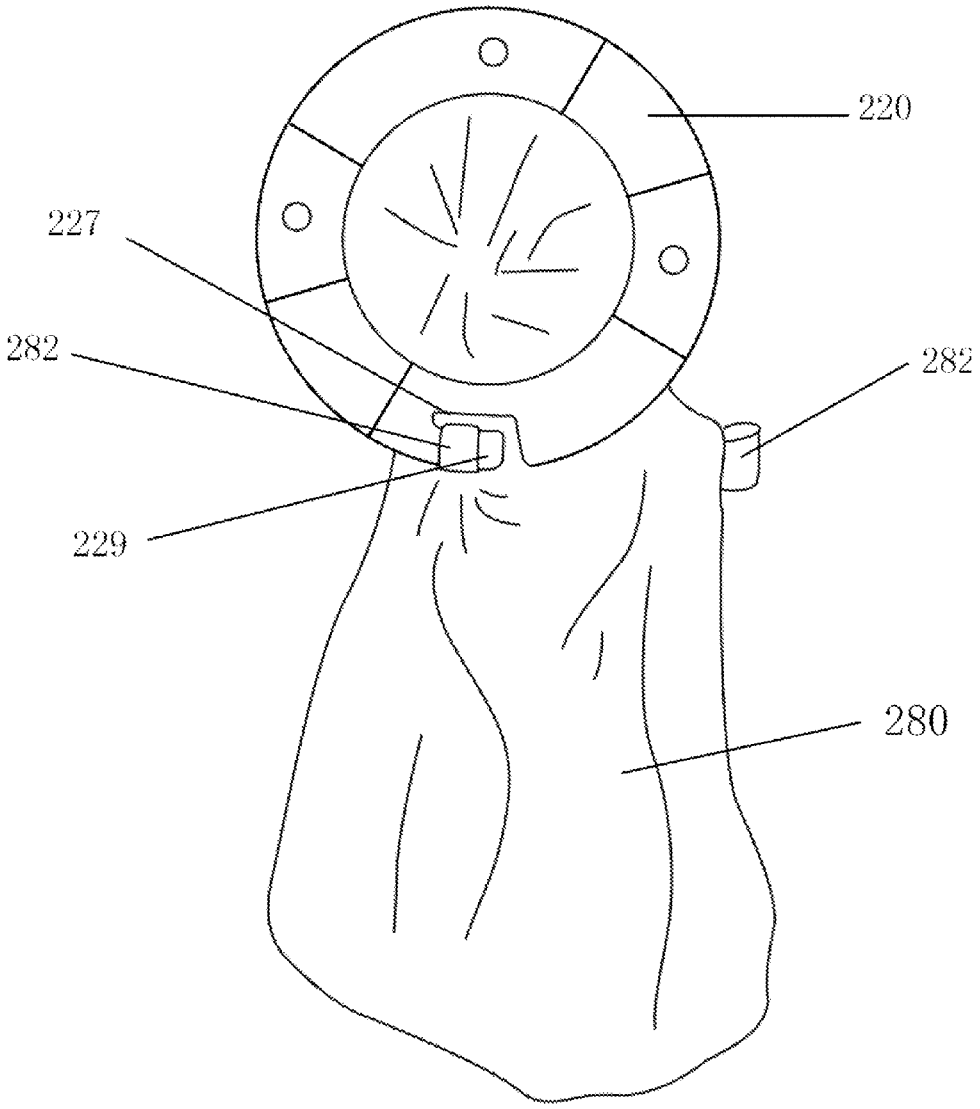
FIG. 9B is a perspective view of another embodiment of the disposable bag also with a twisted neck but the twisted neck is hidden behind the foldable collar. This figure illustrates a finger of the foldable collar being engaged with a sleeve of the enclosure body.
Figure 9C:
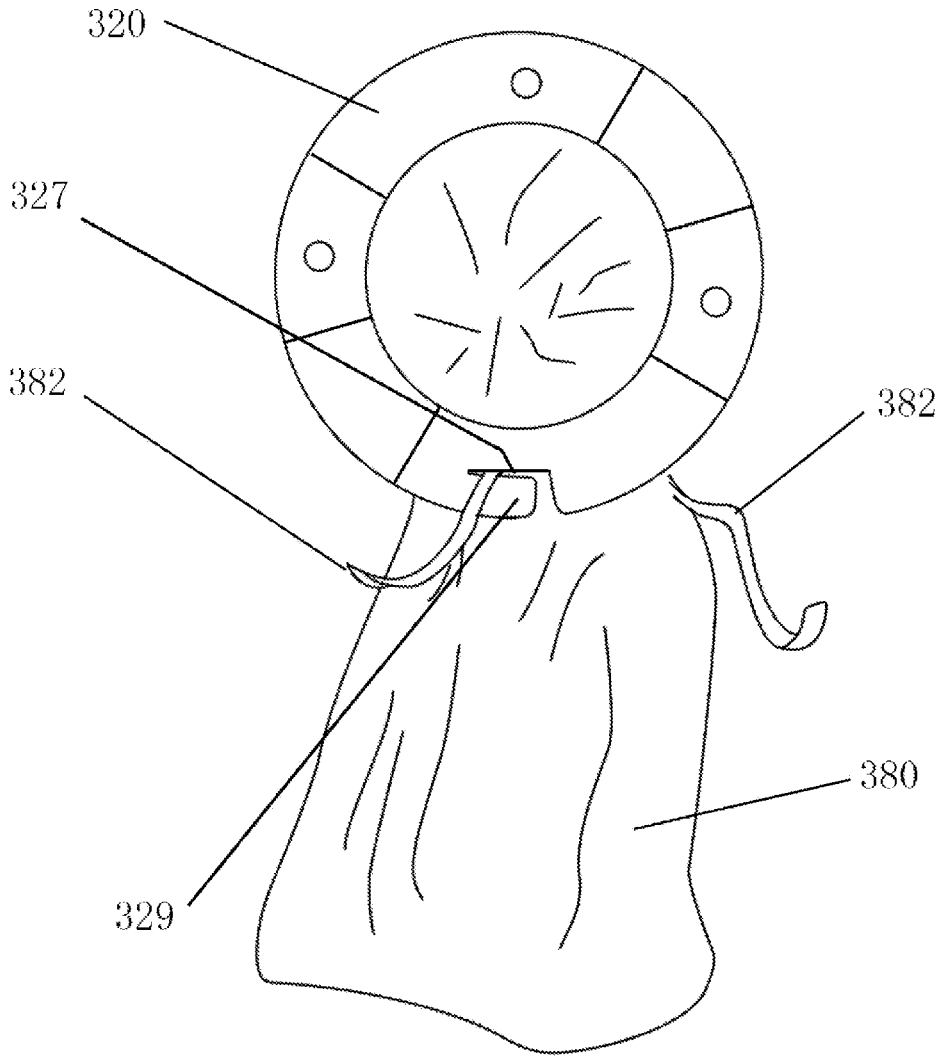
FIG. 9C is a perspective view of yet another embodiment of the disposable bag also with a twisted neck but the twisted neck is hidden behind the foldable collar. This figure illustrates a locking notch of the foldable collar being engaged with a strip of the enclosure body.
Figure 9D:
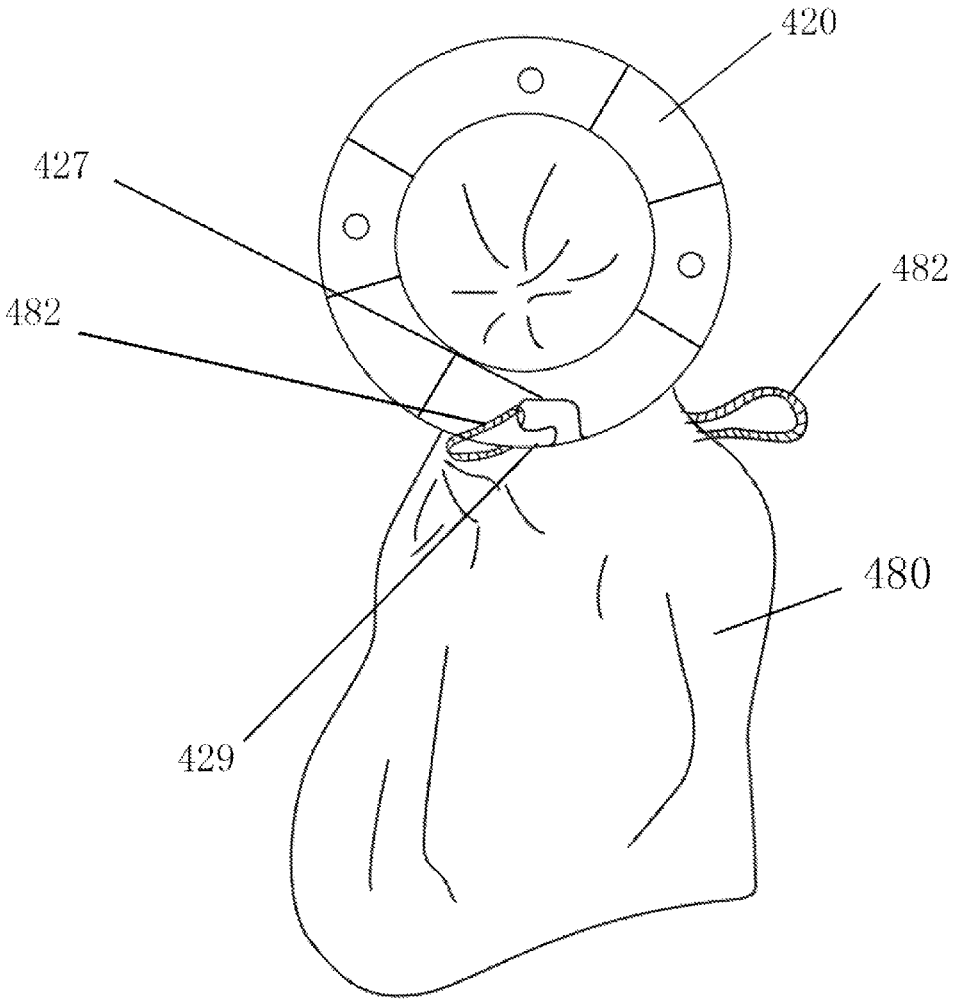
FIG. 9D is a perspective view of a further embodiment of the disposable bag also with a twisted neck but the twisted neck is hidden behind the foldable collar. This figure illustrates a finger of the foldable collar being engaged with a loop of the enclosure body.

The contemplated embodiments can have a receiving channel 127 disposed next to the finger 129. The receiving channel 127 can have various widths and is designed to be sufficiently wide to abuttingly receive a part of the disposable bag. For example in FIG. 9A, the bag 100 has a twisted neck hidden behind the foldable collar 120. Here, the finger 129 hooks into aperture 182 which is disposed on the shoulder portion of the enclosure body 180. When aperture 182 wraps around finger 129, the surrounding region of aperture 182 is received into the channel 127. In another example shown in FIG. 9B, the twisted neck is hidden behind the foldable collar 220, and the finger 229 hooks into sleeve 282 which is disposed on the shoulder portion of the enclosure body 280. When sleeve 282 wraps around finger 229, a part of the sleeve 282 is received into the channel 227. In this particular embodiment, the width of the channel 227 need not be sufficiently narrow to fittingly receive the sleeve 282. Here, it is more important for the finger 229 to have a width that fittingly and correspondingly inserts through sleeve 282. Contrarily, in another example shown in FIG. 9C, which has a twisted neck hidden behind the foldable collar 320, the width of the finger 329 is not as important as the width of the channel 327. Here, channel 327 is a narrow slit to receive and hold a strip 382 which is disposed on the shoulder portion of the enclosure body 380. A user may optionally wrap strip 382 around the finger 329 repeatedly so the strip 382 can be more securely fastened to the foldable collar 320. In a further example shown in FIG. 9D, which also has a twisted neck hidden behind the foldable collar 420, the widths of both the finger 429 and the channel 427 are not critical as long as any hook-like structure is provided to hook onto the loop 482 which is disposed on the shoulder portion of the enclosure body 480. In some other embodiments, such as those previously described for FIGS. 14A, 14B, and 14C, the channel 127 may be sufficiently wide to receive a twisted neck 189 as shown in FIGS. 8A and 8B. When used this way, apertures 182 can be left unused.

The contemplated embodiments disclose a disposable bag 100 with a foldable collar 120 having through-holes 122 disposed on the foldable collar 120. In one embodiment, there can be only one through-hole. In another embodiment, there can be at least two through-holes (see FIG. 4). In yet another embodiment, there can be at least three through-holes 122 (see FIG. 2). Through-hole 122 is an opening through which some kind of support structure from the waste container can pass, thereby keeping the foldable collar 120 in the desired position. Although through-holes 122 in most of the embodiments in the disclosure are circular, other shapes and sizes are also contemplated. For example, an X-shaped through-hole is provided in FIG. 3 to receive some kind of support structure from the waste container. In this embodiment, collar bodies 223A, 223C, and 223F can be made of pliable material such as plastic or cardboard, which allows any support structure from the waste container to push through the X-shaped through-hole 222.

The disclosure also includes a method of waste management using a waste container and a disposable bag having a foldable collar. By using a disposable bag having a foldable collar disposed about the mouth opening of the bag, the foldable frame acts as a rigid or semi-rigid coupler to securely fasten the mouth opening of the bag to the waste container. This foldable collar may work with corresponding structure on the waste container to keep the mouth opening of the bag from moving. In some embodiments, the foldable collar does not need to work with corresponding structure on the waste container to keep the mouth opening of the bag from moving. For example, this is feasible by using flexible collar with similar characteristic as a rubber-band so that it would fasten on the waste container based on friction.

In other embodiments, the foldable collar can have at least two collar bodies each pivotably foldable in relation to another via pre-scored folding lines. In some embodiments, there can be at least four collar bodies. In yet another embodiment, there can be at least six collar bodies 123A, 123B, 123C, 123D, 123E, 123F. Using collar bodies 123A, 123B, 123C, 123D, 123E, 123F pivotably foldable along pre-scored folding lines allows the foldable collar to collapse into a smaller profile.

Figure 6:
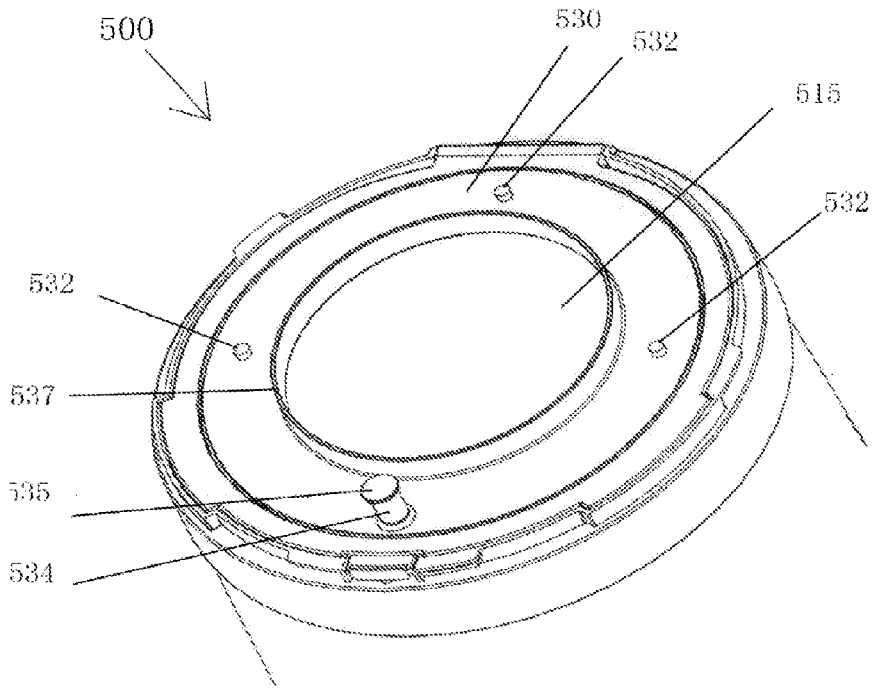
FIG. 6 is a top perspective view of a diaper pail showing a top for receiving the contemplated foldable collars.

Referring now to FIG. 6 which shows a waste container 500 without the disposable bag 100 in place. The waste container 500 has a top 530, corresponding structures 532 in the shape of short cylindrical columns, an interior wall of the waste container 515, a knob 534, a head of the knob 535, and a short circular wall 537. Because the disposable bag 100 is not in place, the interior wall 515 of the container is clearly visible from looking through the circular opening defined by the short circular wall 537.

Figure 7:
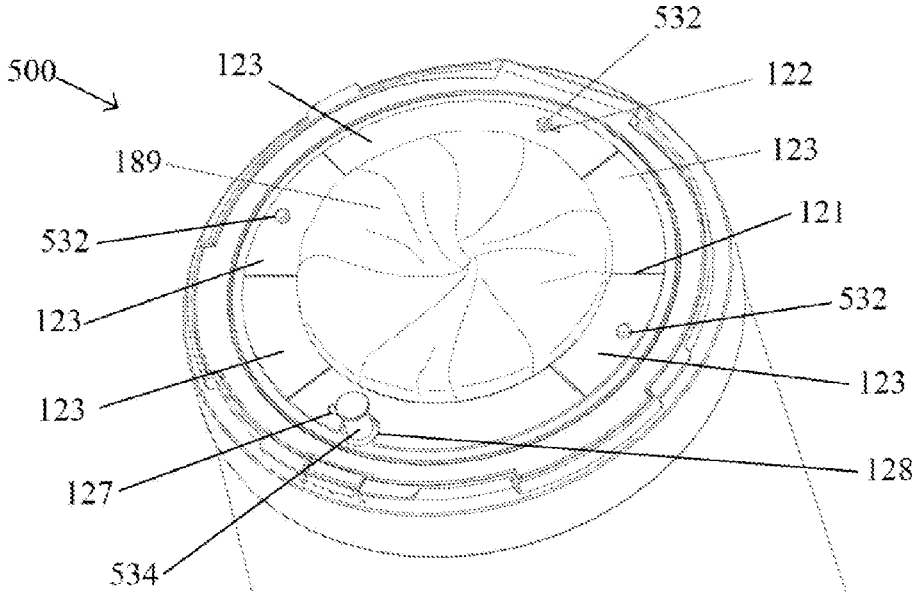
FIG. 7 is a top perspective view of a diaper pail with one embodiment of the disposable bag installed and a twisted neck visible.

Contemplated methods of the disclosure include the step of placing an enclosure body 180 portion of the disposable bag 100 into the waste container 500. Next, placing the foldable collar 120 over a top 530 of the waste container 500 so the enclosure body 180 and the foldable collar 120 are now on either side of the top 530 of the waste container 500. In FIG. 7, because the enclosure body 180 is inside of the waste container 500, the interior wall 515 of the waste container 500 is no longer visible from looking through the opening defined by the circular wall 537. Instead, one may see the interior of the enclosure body 180 by looking through the opening defined by the circular wall 537.

FIG. 7 shows the foldable collar 120 being folded out and secured to the top 530 of the waste container 500 thereby keeps the foldable collar 120 from rotating relative to the top 530 of the waste container 500. The step of securing the foldable collar 120 to the top 530 of the waste container 500 can be accomplished by inserting the three short cylindrical columns 532 through the three through-holes 122. As shown in FIG. 7, the foldable collar 120 is secured in place and cannot easily disengage from the top 530 of the waste container 500. In FIG. 7, the short circular wall 537 is not visible because the bag now drapes over it. In one embodiment, after the foldable collar 120 is secured in place to the top 530, the user may hold the knob 534 and rotate the top 530 which in turn rotates the foldable collar 120 thereby creating a twist in the neck 189 as shown in FIG. 7. In some embodiments, there are certain bag attachment mechanisms inside of the waste container 500 to hold the enclosure body 180 of the bag in place. In further embodiments, the bag attachment mechanism holds the enclosure body 180 by engaging with aperture 182 (or sleeves 282, strip 382, loop 482).

When the disposable bag 100 is full and is ready to be removed from the waste container 500, there can be various ways to accomplish this depending partly on features provided on the waste container 500. For purpose of discussion, assuming a simple version of waste container 500 is used in the illustrated FIGS. 6 and 7. The contemplated removal method includes releasing the foldable collar 120 from the top 530 of the waste container 500. This simply means pulling the foldable collar 120 upwards so that the short cylindrical columns 532 are no longer inserted through the through-holes 122. Then, collapsing the foldable collar 120 into a smaller profile as shown in FIGS. 10, 11, 12, and 13 then pass the collapsed foldable collar 120 downward through the circular opening defined by the short circular walls 537.

The user may now remove the top 530 of the waste container 500 by lifting the top 530 from the waste container 500. In one embodiment, this top 530 is hinged to the waste container 500 and can pivot open so the user may have access to the bag 100. In another embodiment, this top 530 can be fully detached from the waste container 500 so that user may have access to the bag 100.

Now with the top 530 out of the way, the bag 100 is ready to be removed from the waste container 500. In some embodiments of the waste container 500, the neck 189 of the disposable bag 100 is already kept in a twisted configuration. In other embodiments of the waste container 500, the neck 189 of the disposable bag 100 is not kept in a twisted configuration and the user would need to create this twisted neck configuration by rotating either the foldable collar 120 or the enclosure body 180 against each other.

An important step of the contemplated method includes using the locking notch 128 or finger 129 from the foldable collar 120 to abuttingly engage either the twisted neck 189, or shoulder portion of the bag as previously described so as to keep the neck 189 from untwisting.

Now the bag 100 is securely twisted shut at its neck portion 189 and prevented from untwisting, a user can remove the bag 100 from the waste container 500.

Figure 15:
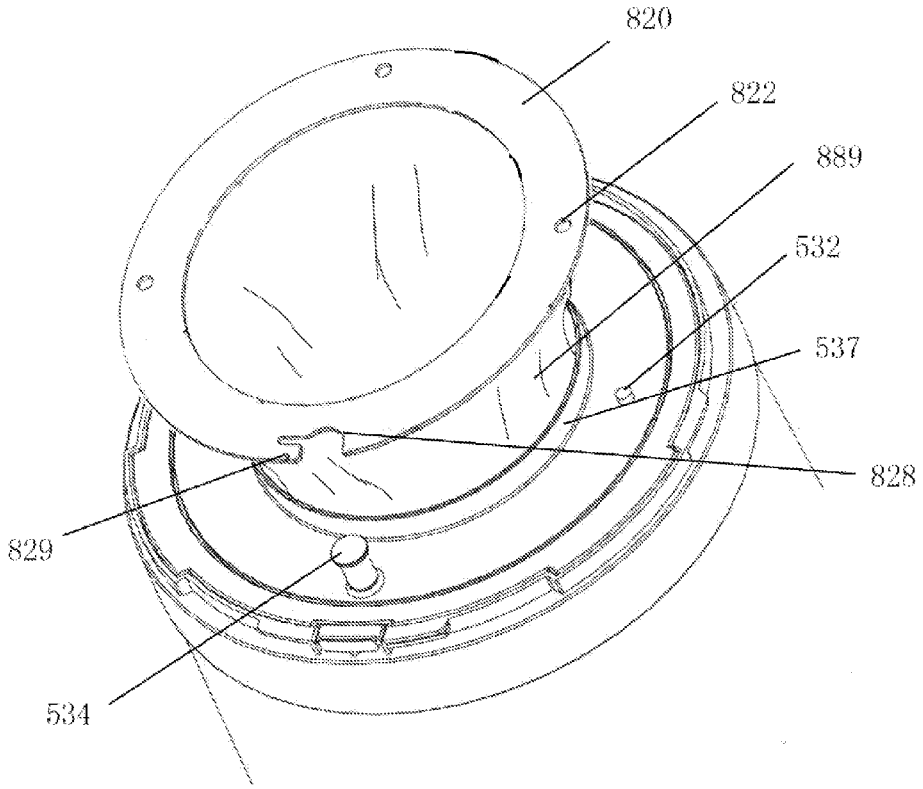
FIG. 15 shows one particular embodiment of the disposable bag having a collar without any folding lines, and the collar is being disengaged from the waste container.

Although most of the discussions herein relate to collar that is foldable, it should be especially recognized that some embodiments do not require any folding lines. In FIG. 15, a disposable bag can have a collar 820 without folding lines. The collar can have through-holes 822 to engage with corresponding structures 532 on the top 530 of the waste container 500. In FIG. 15, the collar 820 has been lifted off the top 530, and is ready to be inserted through the circular opening defined by the short circular wall 537

Figure 16:
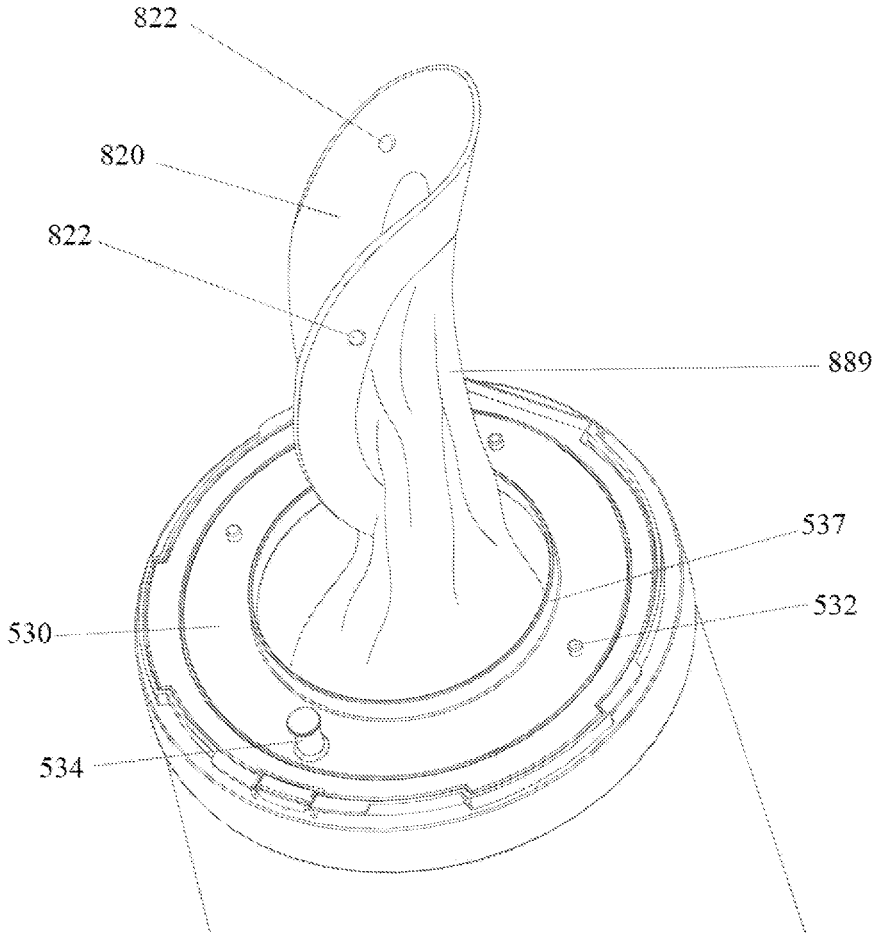
FIG. 16 shows a pliable collar being deformed so it may pass through the circular opening defined by the short circular wall without any need for folding lines.

FIG. 16 shows the collar 820 from FIG. 15 being made of pliable material so it is configured to deform or bend and be passed down through the circular opening defined by the short circular wall 537. Notably in FIG. 16, the neck 889 is not twisted. Whether or not the neck 889 is twisted when a user removes the collar 820 from the top 530 depends on whether or not the user had twisted the neck 889 first by rotating the top 530 using knob 534.

Figure 17:
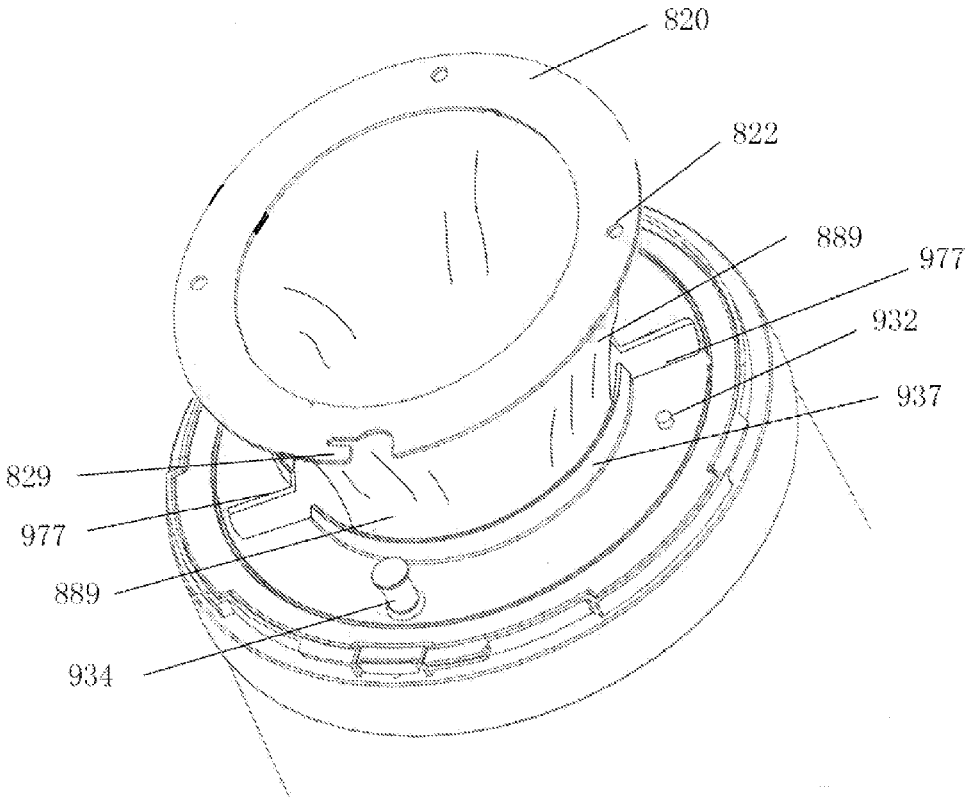
FIG. 17 shows a disposable bag having a collar without any folding lines because the collar can fit through a slot opening in the top of the waste container without having to bend or fold the collar.

FIG. 17 shows the same collar 820 without any folding lines. In this example, the collar 820 may or may not be made of pliable material because it can easily be passed down through a slot opening 977 made available on the top of the waste container. The top of the waste container has similarly corresponding structures 932, short circular wall 937, and a knob 934 to rotate the top.

Thus, specific embodiments and applications of a disposable bag with a foldable collar have been disclosed. It should be apparent, however, to those skilled in the art that many more modifications besides those already described are possible without departing from the inventive concepts herein. The embodiment, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Insubstantial changes from the claimed subject matter as viewed by a person with ordinary skill in the art, now known or later devised, are expressly contemplated as being equivalent within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what essentially incorporates the essential idea of the disclosure. In addition, where the specification and claims refer to at least one of something selected from the group consisting of A, B, C . . . and N, the text should be interpreted as requiring only one element from the group, not A plus N, or B plus N, etc.

Many alterations and modifications may be made by those having ordinary skill in the art without departing from the spirit and scope of the disclosure. Therefore, it must be understood that the illustrated embodiment has been set forth only for the purposes of example and that it should not be taken as limiting the disclosure as defined by the following claims. For example, notwithstanding the fact that the elements of a claim are set forth below in a certain combination, it must be expressly understood that the disclosure includes other combinations of fewer, more or different elements, which are disclosed herein even when not initially claimed in such combinations.

What is claimed is:

1. A disposable bag for a waste container, the bag comprising:

a body portion having an internal space;

a neck portion coupled to the body portion;

a mouth opening defined by an upper rim of the disposable bag, and the upper rim is coupled to the neck portion; and a collar fixed on or near the upper rim and along an entire circumference of the upper rim;

wherein the collar has a finger and a locking notch;

wherein the collar is planar circular disc and has a plane perpendicular to a longitudinal axis of said body portion;

wherein the collar is configured to be foldable and is comprised of at least four collar bodies consecutively connected; and wherein the collar bodies are flat panels pivotably connected to another via folding lines, and the collar bodies are configured to pivotably fold out into a co-planar configuration, thereby keeping the mouth opening of the bag in an open configuration, and the collar bodies are also configured to pivotably fold into a collapsed configuration such that the collar bodies are parallel to each other, thereby keeping the mouth opening of the bag in a closed configuration; and wherein the body portion has at least one catch member disposed on an upper half of the bag above a midline of the bag, wherein the midline is equidistant to both a top end and a bottom end of the bag, the at least one catch member is configured to receive the finger, and the catch member is selected from the group consisting of an aperture, a reinforced aperture, a sleeve, a strip, and a loop.

2. The bag as recited in claim 1, wherein when the collar bodies are in the collapsed configuration, four of the collar bodies are sandwiched between two of the collar bodies.

3. The bag as recited in claim 1, wherein the collar has a receiving structure configured to make detachable engagement with a top of the waste container.

4. The bag as recited in claim 3, wherein the receiving structure includes at least one through-hole on the collar.

5. The bag as recited in claim 1, wherein the locking notch is at least one of (a) a T-shaped cut out, (b) an L-shaped cut out, and (c) a cove-shaped structure with an entrance narrower than an inside void of the cove-shaped structure.

6. The bag as recited in claim 5, wherein the collar has pre-scored folding lines and the collar bodies are foldable relative to one another.

7. A disposable bag for a waste container, the bag comprising:

a body portion having an internal space;

a neck portion coupled to the body portion;

an opening defined by an upper rim of the disposable bag, and the upper rim is coupled to the neck portion; and a circular disc collar without any folding lines, wherein the collar is coupled to or near the upper rim and along an entire circumference of the upper rim; and wherein the body portion has at least one catch member selected from the group consisting of an aperture, a reinforced aperture, a sleeve, a strip, and a loop; and wherein the catch member is to hook around a twisted neck of the bag or around another part of the bag.

8. The bag as recited in claim 7, wherein the collar is planar and the collar has at least one through-hole.

9. The bag as recited in claim 8, wherein one of collar bodies has a locking notch.

10. The bag as recited in claim 8, wherein the locking notch has a finger and a receiving channel.

11. The bag as recited in claim 7, wherein the collar is circular and planar, and is made of a pliable material.

* * * * *